US008985297B2

(12) United States Patent
Freitag et al.

(10) Patent No.: US 8,985,297 B2
(45) Date of Patent: Mar. 24, 2015

(54) VOUCHER MACHINE

(75) Inventors: Paul Freitag, Steinheim (DE); Udo Petermann, Altenbeken (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 12/599,596

(22) PCT Filed: Jun. 6, 2008

(86) PCT No.: PCT/EP2008/004512

§ 371 (c)(1),
(2), (4) Date: Nov. 10, 2009

(87) PCT Pub. No.: WO2009/000394

PCT Pub. Date: Dec. 31, 2008

(65) Prior Publication Data

US 2010/0213023 A1 Aug. 26, 2010

(30) Foreign Application Priority Data

Jun. 22, 2007 (DE) ..... 10 2007 028 858

(51) Int. Cl.
*G07F 7/04* (2006.01)
*G07D 11/00* (2006.01)

(52) U.S. Cl.
CPC ..... *G07D 11/0081* (2013.01); *G07D 11/0018* (2013.01)
USPC ..... 194/206; 271/301

(58) Field of Classification Search
USPC ..... 194/206, 207; 209/534; 902/8–21; 382/135; 235/379; 271/184, 185, 225, 271/301
See application file for complete search history.

(56) References Cited

U.S. PATENT DOCUMENTS

| | | | | |
|---|---|---|---|---|
| 3,880,320 | A * | 4/1975 | Morello et al. | 221/9 |
| 4,854,452 | A | 8/1989 | Uchida et al. | |
| 4,889,240 | A | 12/1989 | Sato et al. | |
| 5,076,441 | A | 12/1991 | Gerlier | |
| 5,173,590 | A | 12/1992 | Nakano et al. | |
| 5,680,935 | A | 10/1997 | Mistander et al. | |
| 5,897,114 | A * | 4/1999 | Arikawa et al. | 271/272 |
| 5,927,936 | A * | 7/1999 | Arikawa et al. | 414/788 |
| 2004/0182677 | A1 * | 9/2004 | Katou et al. | 194/206 |
| 2005/0060055 | A1 * | 3/2005 | Hallowell et al. | 700/95 |
| 2005/0150738 | A1 * | 7/2005 | Hallowell et al. | 194/206 |
| 2005/0173221 | A1 * | 8/2005 | Maier et al. | 194/207 |

(Continued)

FOREIGN PATENT DOCUMENTS

| | | |
|---|---|---|
| CN | 1822055 | 8/2006 |
| EP | 0 317 537 A2 | 5/1989 |
| EP | 0 379 638 A1 | 8/1990 |
| EP | 0 675 465 A1 | 10/1995 |

(Continued)

OTHER PUBLICATIONS

German Office Action for Application No. 10 2007 028 858.3 dated Mar. 10, 2014 (6 pages).

*Primary Examiner* — Jeffrey Shapiro
(74) *Attorney, Agent, or Firm* — Harness, Dickey & Pierce, P.L.C.

(57) ABSTRACT

A voucher machine, particularly an automated teller machine, for the input and output of vouchers such as cash or checks, having a processing section (1) for transporting and processing vouchers to be input and output, is characterized in that the processing section (1) has two processing circuits (5, 6) for processing input vouchers which allows rapid output of vouchers identified as unsuitable for acceptance.

20 Claims, 4 Drawing Sheets

(56) References Cited

U.S. PATENT DOCUMENTS

| | | | | |
|---|---|---|---|---|
| 2005/0202771 | A1* | 9/2005 | Shimizu et al. | 453/1 |
| 2006/0090983 | A1* | 5/2006 | Katou et al. | 194/206 |
| 2007/0034683 | A1 | 2/2007 | Eastman et al. | |
| 2010/0164161 | A1* | 7/2010 | Katou et al. | 271/3.14 |

FOREIGN PATENT DOCUMENTS

| | | | |
|---|---|---|---|
| EP | 0 735 513 | A1 | 10/1996 |
| EP | 0 793 200 | A2 | 9/1997 |
| EP | 1 571 603 | A1 | 9/2005 |
| GB | 2 236 524 | A | 4/1991 |

* cited by examiner

VOUCHER MACHINE

FIELD

The invention relates to a voucher machine for the input and output of vouchers, such as cash or checks, in accordance with the preamble of claim 1.

BACKGROUND

Voucher machines configured as self-service devices—refer to US 2007/0034683 A1, for example—for the input and output of vouchers such as bank notes or checks usually have a deposit drawer to input the vouchers to which a circulatory processing section is attached downstream. In addition to transport rollers and/or belts, this processing section usually comprises several stations, such as a sensor system to identify folded or damaged bank notes, or those with foreign objects attached, a station to verify authenticity, one or more roller storage systems for temporary storage of vouchers, a valuables cassette to store vouchers and an output drawer for vouchers to be output, including vouchers that were not accepted at the time they were input.

This structure has proved itself in its essentials, but in operation it often leads to relatively long transaction times.

SUMMARY

The object of the invention is to solve this problem.

The invention achieves this object with the subject of claim 1.

Since, in addition to the longer processing circuit, the processing section includes a shorter processing circuit for the direct re-output of vouchers identified by the sensor system as unsuitable for acceptance, unsuitable bills can be re-output directly after they have been identified so that the transaction in such cases can be shortened. Moreover, this reduces the risk that the vouchers identified as unsuitable—for example, if they have metal items such as staples adhering to them—may cause operating malfunctions in the longer processing circuit.

Advantageous embodiments can be found in the dependent claims.

BRIEF DESCRIPTION OF THE DRAWINGS

The invention is described hereinafter in greater detail using embodiments with reference to the drawing.

DETAILED DESCRIPTION

Figure 1:
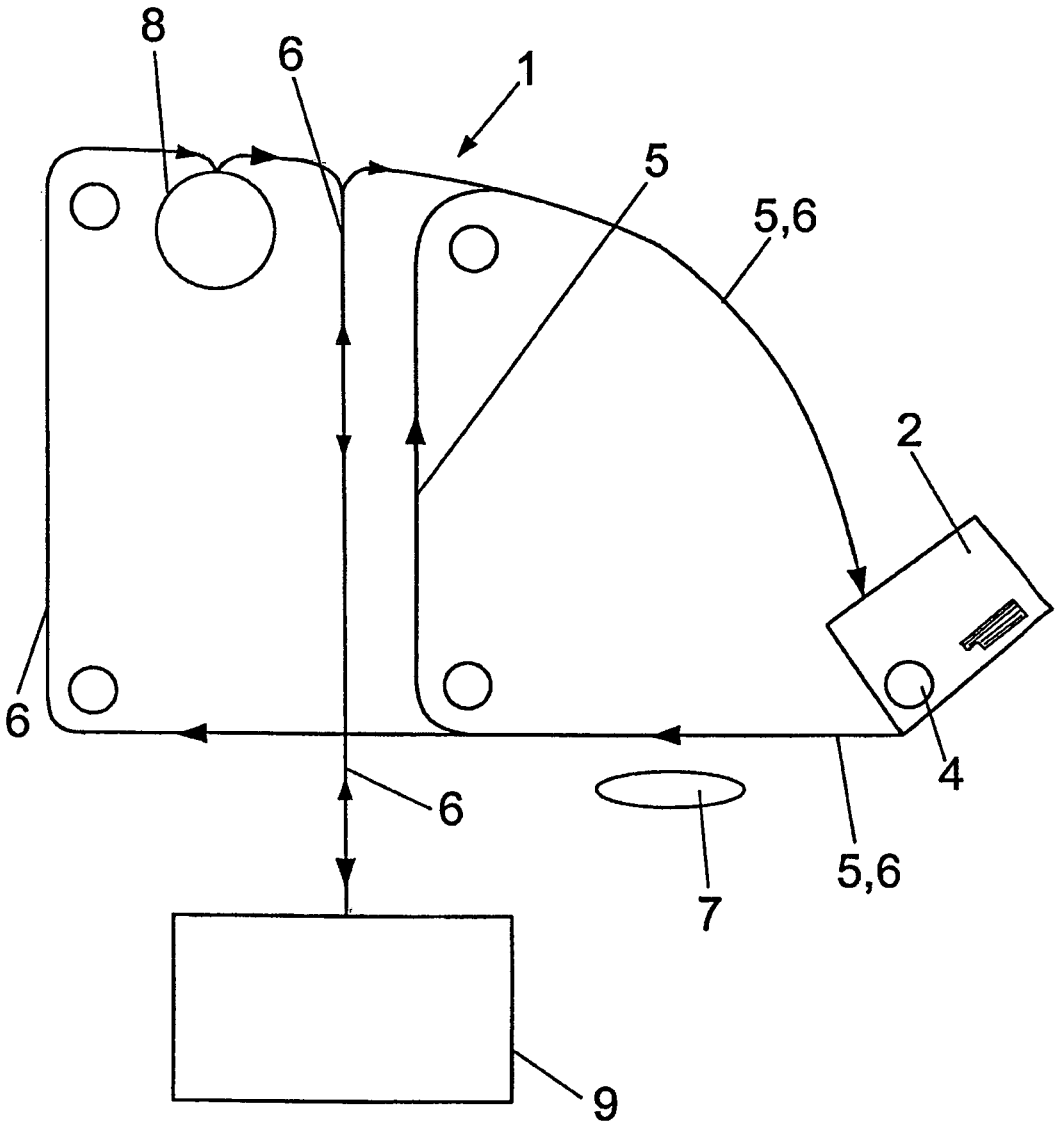
FIG. 1 shows a schematic representation of a processing circuit for vouchers in a voucher machine.

FIG. 1 shows a schematic representation of a processing section 1 for vouchers in a voucher machine not otherwise shown. The voucher machine has a combination input and output drawer 2 for the input and output of vouchers that are collected into a bundle or stack 3 in the representations of FIGS. 2 to 4. The input and output drawer 2 is designed for the input of one or more vouchers. It is preferably designed in such a way that up to 200 vouchers can be processed in a single transaction.

Figure 2:
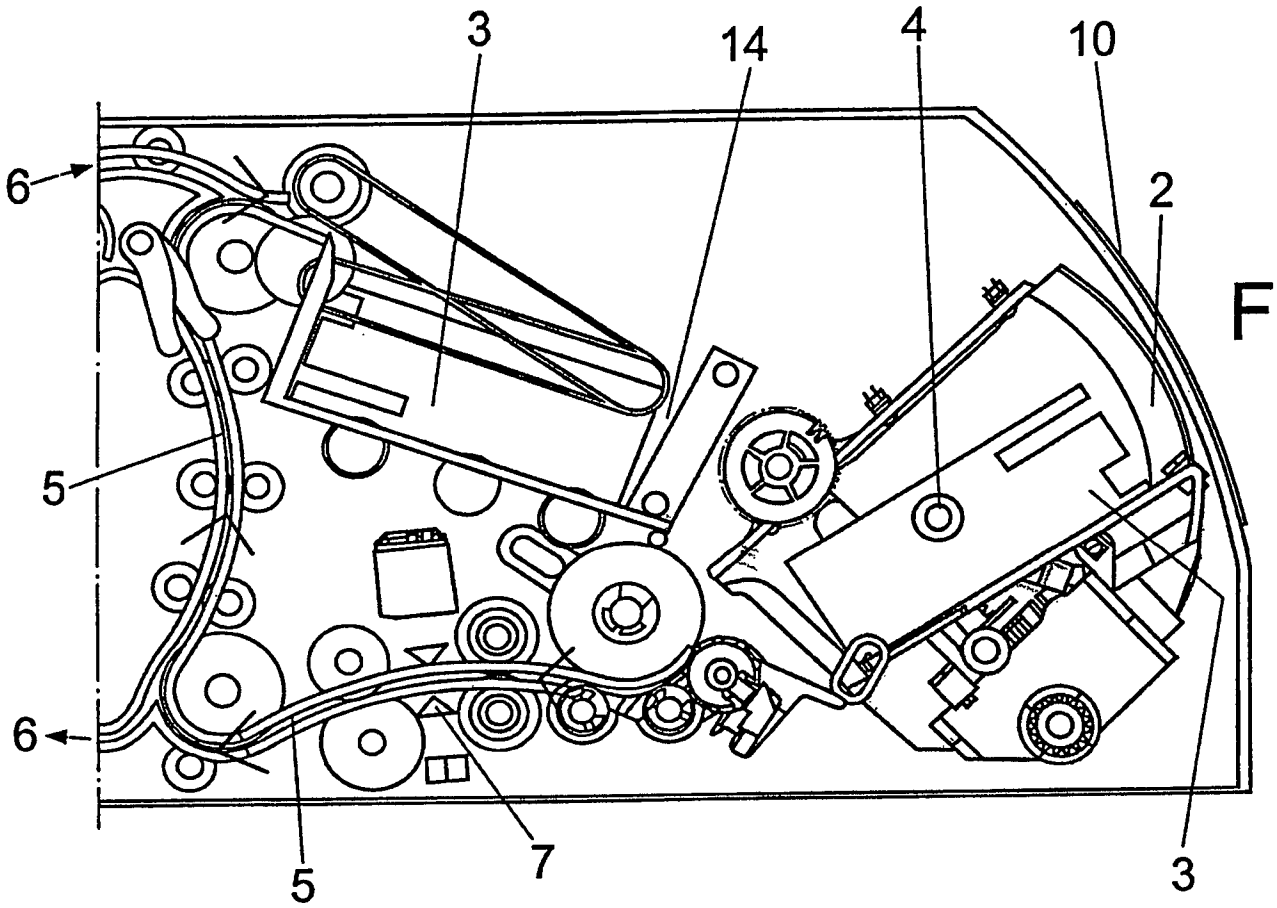
FIGS. 2-4 show a partial area of a processing section for vouchers in a voucher machine in different operating positions.
Figure 3:
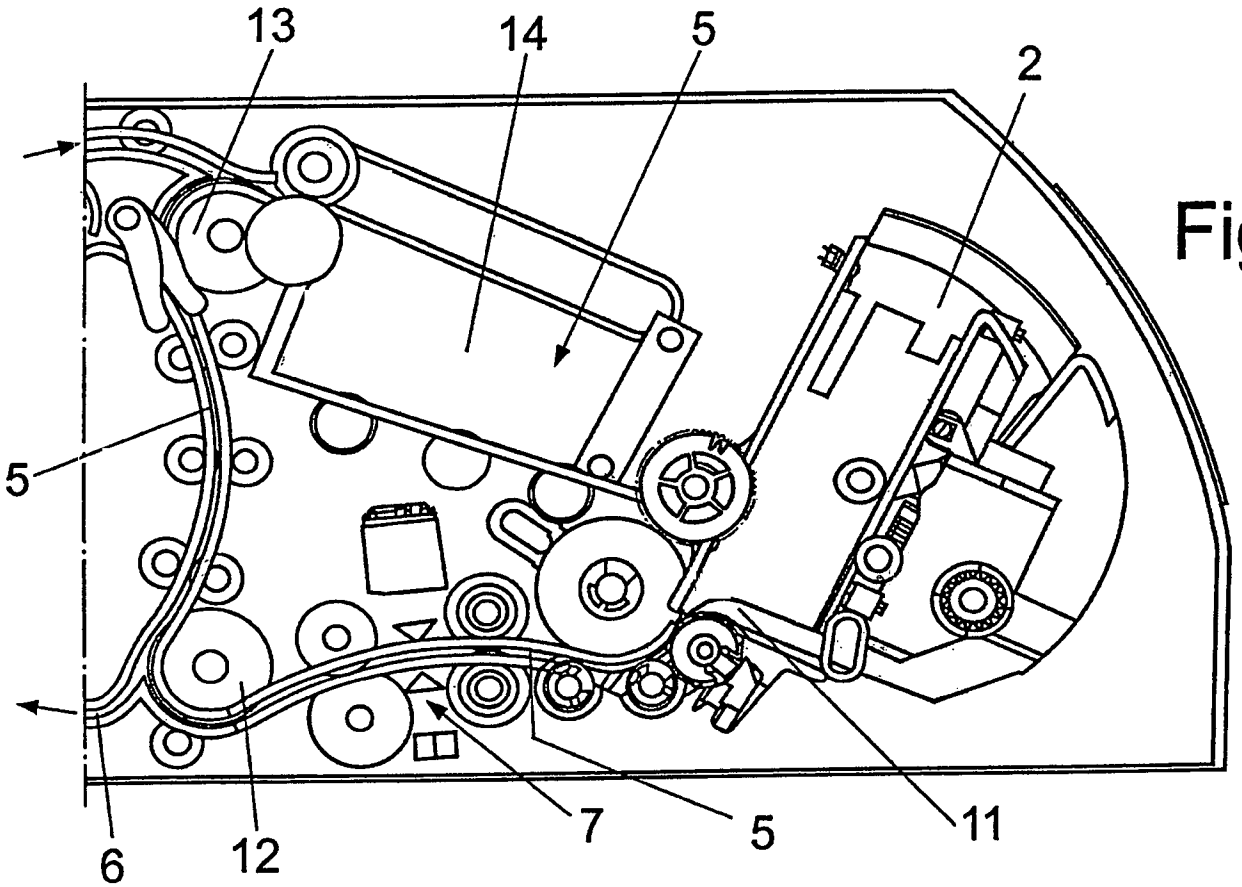
Figure 4:
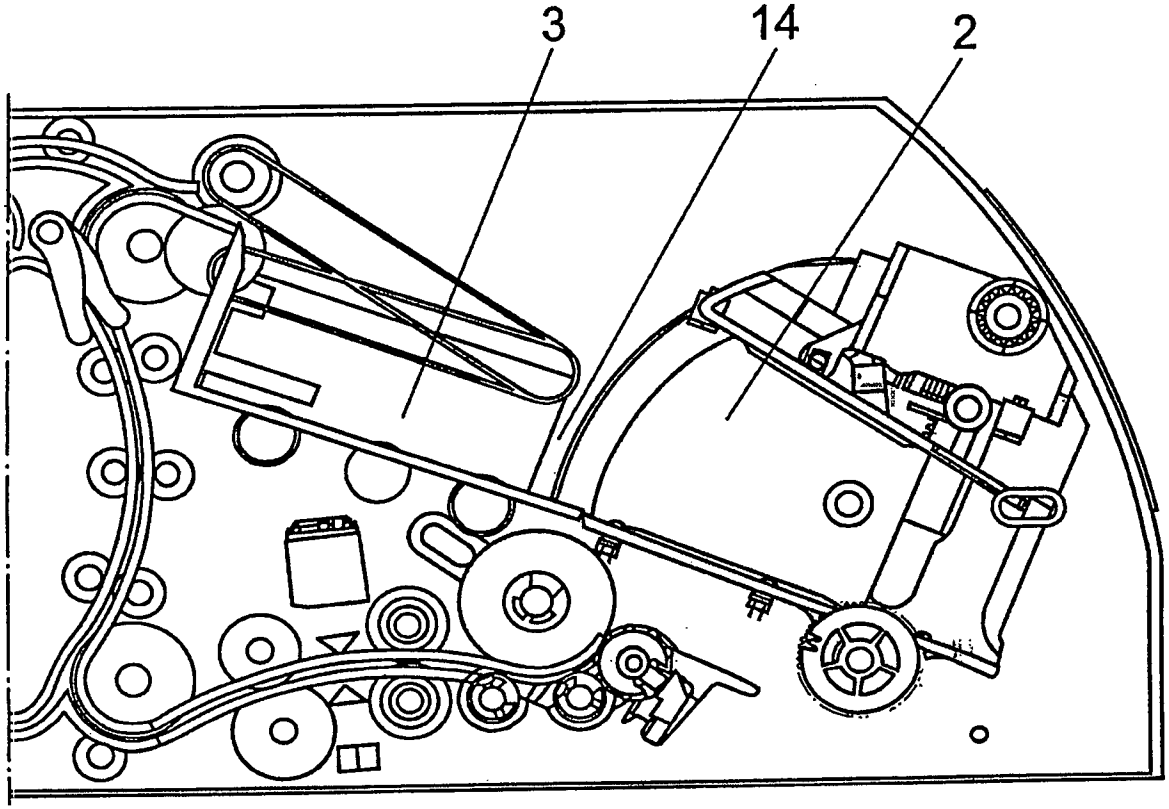

The input and output drawer 2 is carried pivotably on an axis of rotation 4 so that it can pivoted through an angle, here for example of about 100°, into the operating positions in FIGS. 2 to 4.

The input and output drawer 2 is the start and endpoint respectively of the processing section 1 to transport and process vouchers to be input and output.

In accordance with FIG. 1, this processing section 1 has a first—shorter—processing circuit 5 and a second—longer—processing section 6, wherein the processing circuits 5, 6 overlap in sections—in this case at the beginning and at the end.

The shorter processing circuit 5 serves to re-output as directly as possible vouchers identified at a sensor system 7 as unsuitable, meaning, for example, that they are damaged, crumpled or contain a foreign body, bypassing additional stations such as roller storage systems and a valuables cassette where applicable.

Vouchers can be output in the combination input and output drawer 2 provided here or in a separate output drawer (not shown here), wherein preference is given to the first variant because of its simpler construction.

Input vouchers that have not been rejected by the sensor system and taken to the output undergo further processing in the longer processing circuit 6. Stations for additional processing may include an authenticity check and temporary storage in one or more voucher storage systems, for example, on roller storage systems 8 and storage in a valuables cassette 9.

The longer processing circuit 6 additionally serves to output vouchers when the voucher machine is used as an automated teller machine, for example, or if an additional deposit is cancelled by the user after it has passed the sensor system 7.

Since the shorter processing circuit 5 is configured very much shorter than the longer processing circuit 6, transaction time is considerably shortened in all cases in which the sensor system 7 identifies vouchers that are damaged, folded or contain foreign bodies, which has an advantageous effect on the operating efficiency of the voucher machine.

The input/output drawer 2 forms a manual interface between an operator and the system, or the processing sections respectively. Other components of the voucher machine, such as a display or a keypad and the housing are not shown in FIGS. 1 to 4, or only sections thereof.

After a shutter 10 has been opened, a maximum of 200 vouchers, with the long side to the front, can be placed in the input/output drawer 3 by the operator. The entire bundle is rejected if the thickness of the bundle exceeds 90 mm.

After the bundle has been inserted correctly (FIG. 2), the shutter 10 closes and the input and output drawer 2 pivots into a position for individual separation (FIG. 3). Individual separation of the input vouchers 2 is carried out, for example, at a separating station 11 operating on the principle of draw-off shaft, drive roller shaft, countershaft and retaining comb.

After they have been individually separated, the vouchers are inspected at the sensor system 7 for foreign bodies. Multiple draw-offs, the size of the vouchers and the position of the vouchers are preferably identified and evaluated by the sensor system 7, which can comprise several sensors. Vouchers identified as unsuitable for the machine (e.g. vouchers folded once lengthwise or crosswise, vouchers with staples, etc.) are then diverted over the "short" processing circuit 5 by means of jockey rollers 12, 13 directly into a collecting drawer 14. A maximum of 200 notes can be stacked in the collecting drawer 14. The sensor system 7 preferably also identifies individual notes folded once crosswise or lengthwise.

The collected notes are then transported back from the collecting drawer 14 to the empty input and output drawer 2, now pivoted into the position in FIG. 4. After the input and output drawer 2 has been suitably rotated back into the position in FIG. 2, the stack 3 can either be sorted individually again or it is proffered to the operator for removal.

If the notes jam, the remaining notes first have to be removed from the input and output drawer 2, then, any notes are transported from the collecting drawer 14 into the input and output drawer 3 from which they can be removed after the shutter 10 is opened.

If, on the other hand, the vouchers are identified at the sensor system 7 as suitable for further processing, they are taken past the jockey roller 12 into the longer processing circuit 6 that is only indicated roughly in FIG. 2 and that comprises a station for the authenticity check and at least one voucher storage system 8, 9. For disbursal, vouchers are taken from these voucher storage systems 8, 9 again, first into the collecting drawer 14 before they are output into the input and output drawer 3 in the manner of FIG. 3.

REFERENCE NUMERALS

Processing section 1
Input and output drawer 2
Bundle 3
Axis of rotation 4
Processing circuit 5
Processing circuit 6
Sensor system 7
Roller storage system 8
Valuables cassette 9
Shutter 10
Individual separation station 11
Jockey rollers 12, 13
Collection drawer 14

What is claimed is:

1. A self-service voucher system for inputting and outputting vouchers, the self-service voucher system comprising:

a first processing circuit that is a closed loop circuit, wherein the processing circuit comprises circuitry configured to (i) retrieve vouchers from a combined input and output drawer in which a customer interfaces with the vouchers, (ii) provide the received vouchers from the combined input and output drawer to a sensor system, (iii) forward the rejected ones of the received vouchers from the sensor system to a collecting drawer, (iv) return the rejected ones of the received vouchers from the collecting drawer back to the combined input and output drawer, (v) subsequent to returning the rejected ones of the received vouchers from the collecting drawer and prior to any customer interference with the rejected ones of the received vouchers returned to the combined input and output drawer, again retrieve the rejected ones of the received vouchers from the combined input and output drawer, and (vi) via the sensor system, reevaluate the rejected ones of the received vouchers retrieved again from the combined input and output drawer; and a second processing circuit configured to process vouchers that are not rejected by the sensor system.

2. The self-service voucher system of claim 1, wherein the first processing circuit and the second processing circuit overlap in sections.

3. The self-service voucher system of claim 1, wherein the first processing circuit is shorter than the second processing circuit.

4. The self-service voucher system of claim 1, wherein the combination input and output drawer is designed to be pivotable.

5. The self-service voucher system of claim 1, wherein the first processing circuit comprises the sensor system, wherein the sensor system is configured to identify vouchers unsuitable for acceptance, and wherein the vouchers unsuitable for acceptance include folded vouchers, damaged vouchers, and vouchers with foreign bodies attached.

6. The self-service voucher system of claim 1, wherein the first processing circuit is configured to divert and output vouchers identified at the sensor system as unsuitable directly into the collecting drawer or an output drawer.

7. The self-service voucher system of claim 1, wherein the second processing circuit comprises at least one voucher storage system, and wherein the at least one voucher storage system includes one or more roller storage systems or the collecting drawer for storing vouchers.

8. The self-service voucher system of claim 7, wherein the collecting drawer is located upstream from the combined input and output drawer.

9. An automated teller machine comprising the self-service voucher system of claim 1.

10. The self-service voucher system of claim 1, wherein the rejected ones of the received vouchers include at least one of unsuitable vouchers and misaligned vouchers.

11. The self-service voucher system of claim 1, further comprising the sensor system, wherein during a first iteration:

the sensor system evaluates N vouchers received by the combined input and output drawer, wherein N is an integer; and the first processing circuit (i) separates M vouchers from the N vouchers, (ii) collects the M vouchers in the collecting drawer, and (iii) transfers the M vouchers back to the combined input and output drawer, wherein M is an integer less than N, wherein the M vouchers are the rejected ones of the received vouchers.

12. The self-service voucher system of claim 11, wherein during a second iteration, the first processing circuit (i) separates L vouchers from the M vouchers, (ii) collects the L vouchers in the collecting drawer, and (iii) transfers the L vouchers back to the combined input and output drawer, where L is an integer less than M.

13. The self-service voucher system of claim 11, wherein, subsequent to the first iteration, the first processing circuit selectively (i) proffers the M vouchers to an operator or (ii) reprocesses the M vouchers.

14. The self-service voucher system of claim 13, wherein the reprocessing of the M vouchers includes the first processing circuit (i) separating L vouchers from the M vouchers, (ii) collecting the L vouchers in the collecting drawer, and (iii) transferring the L vouchers back to the combined input and output drawer, where L is an integer less than M.

15. The self-service voucher system of claim 1, wherein:

the second processing circuit comprises at least one of a roller storage system and a valuables cassette;

the at least one of the roller storage system and the valuables cassette temporarily stores the vouchers that are not rejected by the sensor system; and at least one of the first processing circuit and the second processing circuit (i) transfers the vouchers that are not rejected by the sensor system from the at least one of the roller storage system and the valuables cassette to the collecting drawer and (ii) transfers the vouchers that are not rejected by the sensor system from the collecting drawer to the combined input and output drawer.

16. The self-service voucher system of claim 15, wherein:

the first processing circuit comprises a shared section and transfers the rejected ones of the received vouchers to the collecting drawer via the shared section; and the second processing circuit transfers the vouchers that are not rejected by the sensor system from the at least one of the roller storage system and the valuables cassette to the collecting drawer via the shared section.

17. The self-service voucher system of claim 1, wherein:

the second processing circuit comprises a shared section and at least one of a roller storage system and a valuables cassette;

the second processing circuit transfers the vouchers that are not rejected by the sensor system from the sensing system to the at least one of the roller storage system and the valuables cassette via the shared section; and the first processing circuit transfers the rejected ones of the received vouchers from the sensing system to the collecting drawer via the shared section.

18. The self-service voucher system of claim 15, wherein:

the first processing circuit comprises the sensor system;

subsequent to receiving the vouchers from the customer in the combined input and output drawer and prior to forwarding the rejected ones of the vouchers to the collecting drawer, the sensor system is configured to perform an initial inspection of the vouchers;

the second processing circuit is configured to (i) receive the vouchers that are not rejected by the sensor system during the initial inspection, and (ii) store the vouchers in the at least one of the roller storage system and the valuables cassette;

the second processing circuit comprises a station; and the station is configured to (i) check authenticity of the vouchers subsequent to the initial inspection, and (ii) return the vouchers from the second processing circuit to the collecting drawer.

19. The self-service voucher system of claim 18, wherein the first processing circuit bypasses the second processing circuit if one of the vouchers is rejected by the sensor system during the initial inspection to directly return the one of the vouchers to the collecting drawer instead of forwarding the one of the vouchers to the second processing circuit.

20. The self-service voucher system of claim 18, wherein the sensor system in performing the initial inspection (i) determines whether one or more of the vouchers are folded or include a staple, and (ii) rejects the vouchers that are folded or include a staple.

* * * * *